US005992537A

United States Patent [19]

Pascale

[11] Patent Number: 5,992,537

[45] Date of Patent: Nov. 30, 1999

[54] BACK END CONNECTION IN A DOWNHOLE DRILL

[75] Inventor: Jack H. Pascale, Greentown, Pa.

[73] Assignee: Numa Tool Company, Thompson, Conn.

[21] Appl. No.: 09/087,483

[22] Filed: May 29, 1998

[51] Int. Cl.[6] ..... E21B 4/14

[52] U.S. Cl. ..... 173/91; 173/17; 173/73; 173/80

[58] Field of Search ..... 173/91, 14, 17, 173/201, 204, 73, 78, 80, 213; 91/234; 403/338, 335; 285/407, 406

[56] References Cited

U.S. PATENT DOCUMENTS

| | | | |
|---|---|---|---|
| 3,193,024 | 7/1965 | Cleary | 173/17 |
| 3,229,775 | 1/1966 | Cleary | 173/17 |
| 3,744,577 | 7/1973 | Williams | 403/338 |
| 3,964,551 | 6/1976 | Bassinger | 173/80 |
| 3,970,152 | 7/1976 | Harris et al. | 173/73 |
| 4,054,180 | 10/1977 | Bassinger | 173/80 |
| 4,312,412 | 1/1982 | Pillow | 173/17 |
| 4,333,537 | 6/1982 | Harris et al. | 173/17 |
| 4,530,407 | 7/1985 | Rear | 173/17 |
| 4,530,408 | 7/1985 | Toutant | 173/17 |
| 4,695,079 | 9/1987 | Weinhold | 285/406 |
| 4,819,739 | 4/1989 | Fuller | 173/80 |
| 4,932,483 | 6/1990 | Rear | 175/296 |
| 5,139,096 | 8/1992 | Lister | 173/80 |
| 5,205,363 | 4/1993 | Pascale | 173/17 |

*Primary Examiner*—Peter Vo
*Assistant Examiner*—James P Calve
*Attorney, Agent, or Firm*—Alix, Yale & Ristas, LLP

[57] ABSTRACT

A pneumatic downhole impact drill has a backhead for mounting an inlet check valve and a mounting hub for mounting a fluid delivery tube. A split ring has an interior circumferential groove forming upper and lower shoulders and comprises two substantially identical semi-circular ring segments. The ring segments are positioned around flanges on the backhead and the mounting hub such that the upper shoulder of the split ring slidably engages the upper surface of the backhead flange and the lower shoulder slidably engages the lower surface of the mounting hub flange to mount the backhead to the mounting hub. A first gap is formed between the outside surface of the split ring and the inside surface of the casing. A second gap is formed between the inside surface of the groove and the outside surfaces of the mounting hub and backhead flanges. Taken together, the gaps allow lateral relative movement between the mounting hub and backhead flanges.

10 Claims, 3 Drawing Sheets

BACK END CONNECTION IN A DOWNHOLE DRILL

BACKGROUND OF THE INVENTION

This invention relates generally to pneumatic impact hammers of the type having an impact piston and a fluid delivery tube received within a coaxial bore in the piston for supplying pneumatic pressure fluid to one or both ends of the piston operating chamber for and upon reciprocation of the piston.

U.S. Pat. No. 5,205,363 discloses a conventional hammer and percussion bit assembly having a backhead for mounting an inlet check valve and a mounting hub for mounting a fluid delivery tube. A compression ring or belleville washer is compressed between the backhead and the mounting hub to bias the backhead and mounting hub into engagement with respective snap rings. The snap rings are subject to vibration induced-wear which can lead to failure of the snap rings. In addition, the compression ring/belleville washer was also subject to failure.

SUMMARY OF THE INVENTION

A pneumatic impact drill in accordance with the invention includes a backhead and a mounting hub disposed within the cylinder of the drill. The backhead has a radially extending bore for supplying a flow of pressure fluid to the operating chamber of the drill. A fluid delivery tube is mounted in an axially extending bore of the mounting hub for directing the flow of pressure fluid within the operating chamber. Axially extending flanges on the backhead and mounting hub are received in a circumferential inner groove in a retaining ring to mount the mounting hub to the backhead.

The outer diameter of the retaining ring, the inside diameter of the groove, the inside diameter of the cylinder, and the outside diameter of the backhead and mounting hub flanges are all selected such that the outside surface of the ring and the inside surface of the cylinder define a first gap and the inside surface of the groove and the outside surface of the flanges define a second gap. The first and second gaps cooperate to allow lateral relative movement between the mounting hub and the backhead, facilitating alignment of the bores. A compression ring provides a biasing force to bias the upper surface of the backhead flange and the lower surface of the mounting hub flange to slidably engage the upper and lower shoulders formed by the inner groove of the ring.

It is an object of the invention to provide in a pneumatic impact hammer of the type described, a new and improved backhead and mounting hub, each having a radially extending flange that is received in circumferential inner groove of a ring to mount the mounting hub to the backhead.

It is also an object of the invention to provide in a pneumatic impact hammer of the type described, a new and improved backhead and mounting hub that are mounted together in a manner that permits lateral movement between them.

Other objects and advantages of the invention will become apparent from the drawings and specification.

BRIEF DESCRIPTION OF THE DRAWINGS

The present invention may be better understood and its numerous objects and advantages will become apparent to those skilled in the art by reference to the accompanying drawings in which.

DETAILED DESCRIPTION OF THE PREFERRED EMBODIMENT

Figure 1A:
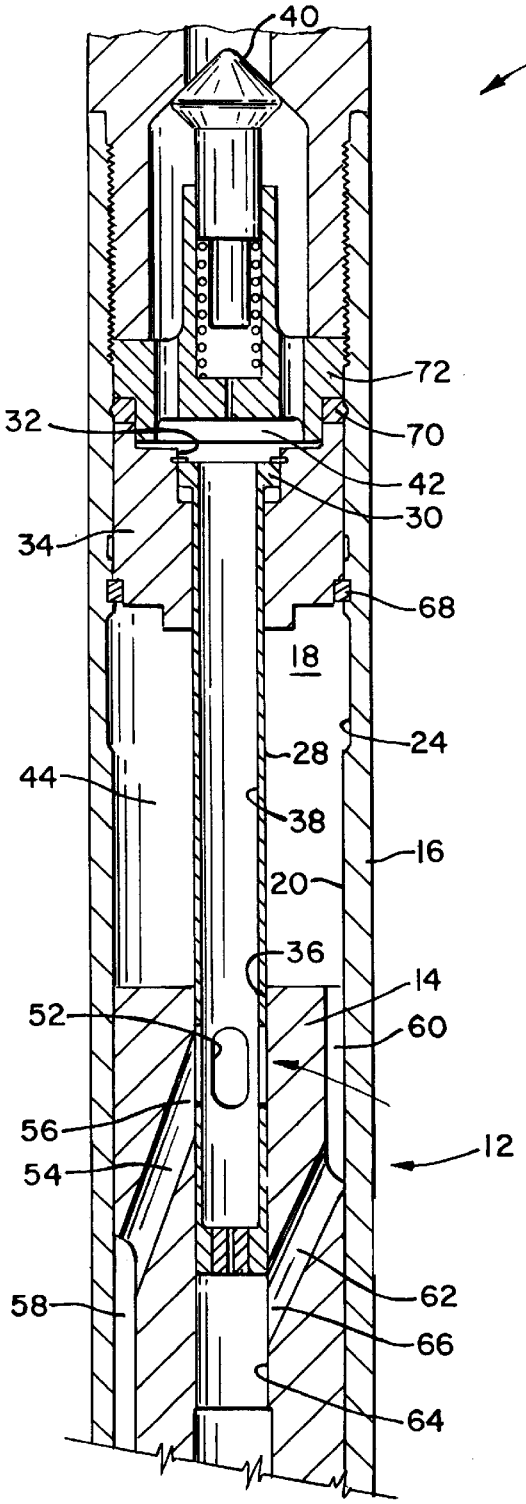
FIG. 1A PRIOR ART
FIGS. 1A and 1B together provide a longitudinal section view, partly broken away and partly in section, of a prior art downhole impact drill showing an impact piston of the drill in a lower or impact position thereof.

In the drawings, the same numerals are used to designate the same or like parts. The apparatus of the present invention has notable utility in downhole impact drills. An example of a downhole impact drill 10 of the type to which the present invention is applicable is disclosed in U.S. Pat. No. 5,205,363, dated Apr. 27, 1993, entitled "Porting System For Pneumatic Impact Hammer", and is hereby incorporated by reference. The downhole impact drill 10 of U.S. Pat. No. 5,205,363 is shown in FIG. 1.

Figure 1B:
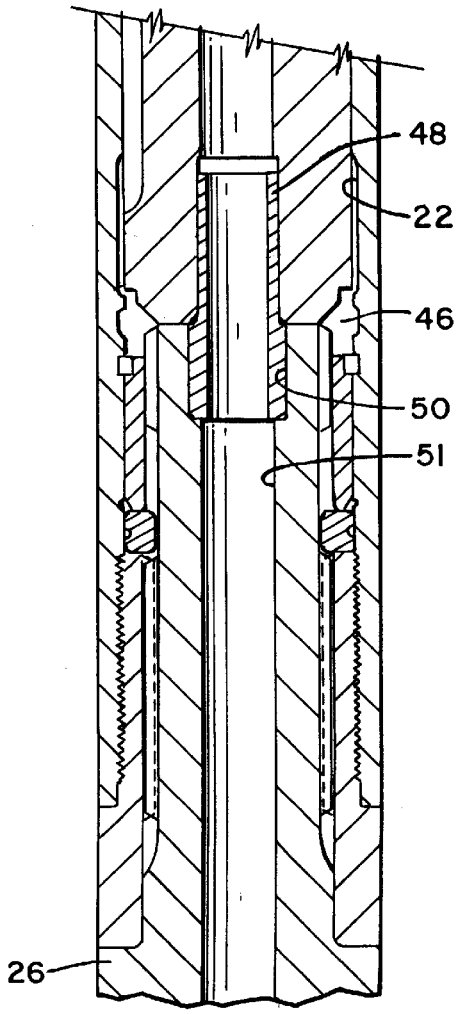
FIG. 1B PRIOR ART

With reference to FIG. 1, downhole impact drill 10 has an impact hammer 12 including an impact piston 14 reciprocable and rotatable within an outer tubular casing or cylinder 16. The cylinder 1 6 forms a piston operating chamber 1 8 and the inner cylindrical surface 20 supports the piston 14 for reciprocation. A pair of axially spaced, internal annular grooves 22, 24 are formed in the cylindrical surface 20. The ID of the cylindrical surface 20 and the OD of the piston 14 are closely matched by grinding and honing the parts to provide a fluid seal therebetween. The piston 14 is reciprocated to impact a drill bit 26 mounted within the lower end of the casing 16 in a conventional manner for downhole percussive drilling in a well-known manner.

A fluid delivery tube 28 is coaxially mounted within the upper end of the cylinder 16 for supplying pneumatic pressure fluid for reciprocating the piston 14. A peripheral, integral mounting flange 30 provided at the upper end of the delivery tube 28 is mounted within a coaxial bore 32 in an upper mounting hub 34. The lower, impact end portion of the delivery tube 28 is slidably received within a stepped coaxial through bore 36 in the piston. During drilling, pressure fluid is continuously supplied to the central axial bore 38 in the tube 28 via an inlet check valve 40 and an inlet plenum 42. Preferably, the fluid is composed of air compressed up to 350 psi or more and a selected amount of lubricating oil and water coolant.

For reciprocating the piston 14, the opposite ends of the piston operating chamber 18 are sequentially connected to exhaust and to receive pressure fluid from the tube 28. As the piston 14 reciprocates, the upper non-impact end of the operating chamber 18, or back chamber 44, is timely connected to exhaust and pressure fluid is timely supplied to the lower impact end of the operating chamber 18, or front chamber 46, to raise or withdraw the piston 14 for a succeeding downward impact stroke. Pressure fluid is timely supplied to the back chamber 44, first to decelerate the upward movement of the piston 14 and then to actuate the piston 14 downward to impact the drill bit 26. Similarly, as the piston 14 reciprocates, the front chamber 46 is timely connected to exhaust to provide for actuating the piston 14 downward with the fluid pressure in the back chamber 44.

The exhaust connection to the front chamber 46 is provided by an exhaust tube 48 having a lower end portion mounted within an axial bore 50 in the upper end of the drill bit 26. The exhaust tube 48 and axial bore 50 form part of an exhaust passageway 51 leading to the lower end of the bit 26. The upper, distal end portion of the exhaust tube 48 is slidably received within the lowest, impact end section of the piston bore 36. The OD of the distal end portion of the exhaust tube 48 and the ID of the impact end section of the piston bore 36 are closely matched by grinding and honing the parts to provide a fluid seal therebetween.

Pressure fluid is supplied from the fluid delivery tube 28 via an annular set of equiangularly spaced, axial slots or ports 52 to the front chamber 46 via an annular set of equiangularly spaced, radially extending bores 54 drilled in the piston 14. The bores 54 extend outwardly from their inner end ports 56 to the upper ends of intermediate, peripheral axial grooves 58 in the piston 14. The axial grooves 58 are equiangularly spaced and cooperate with the lower bypass groove 22 in the casing 16 to timely supply pressure fluid to the front chamber 46.

With the impact piston 14 in engagement with the drill bit 26 as shown in FIG. 1 B, the back chamber 44 is connected to the exhaust passageway 51 via equiangularly spaced, peripheral axial grooves 60 extending downward from the upper end face of the piston 14. An annular set of equiangularly spaced, radially extending bores 62 drilled in the piston 14 connect the grooves 60 to an internal sealing section 64 of the piston 14 below the delivery tube 28. The radial bores 62 extend inwardly from the lower ends of the peripheral axial grooves 60 to the back exhaust/supply ports 66. As shown in FIGS. 1 A and 1 B, the upper end passageway is provided by the upper set of axial grooves 60 and set of drilled bores 62 is completely separate from a lower end passageway provided by the lower set of axial groove 58 and set of drilled bores 54.

With the impact piston 14 in engagement with the drill bit 26, pressure fluid is supplied to the front chamber 46 via the lower end passageway and the back chamber 44 is connected to exhaust via the upper end passageway to provide for raising or withdrawing the piston 14 from the bit 26. As the piston 14 moves upward, the fluid pressure connection to the front chamber 46 terminates when the upper set of inlet ports 56 moves out of registry with the slots 52 or the impact end portion of the impact piston 14 sealingly engages surface 20. The exhaust connection to the back chamber 44 terminates when the exhaust/supply ports 66 move out of registry with the piston bore 36. The piston 14 continues to be actuated upward by the pressure below the piston 14 until after the exhaust tube 48 is uncovered to connect the front chamber 46 to exhaust.

More specifically, as the piston 14 moves upward from the drill bit 26, the back exhaust/supply ports 56 of the lower end passageway are first sealed off by cooperating sealing sections of the delivery tube 28 and piston 14 and then the back exhaust/supply ports 66 move into registry with the slots 52 to supply pressure fluid to the back chamber 44. The axial location and axial spacing of the sets of drilled inlet ports 56 and back exhaust/supply ports 66 and the axial length and axial position of the elongated slots 52 are established to provide the desired timing and piston stroke.

In the downhole impact drill 10 of FIG. 1, mounting hub 34 is firmly mounted within the upper end of the casing 16 between an inner, internal main bore snap ring 68 and an upper compression ring 70 or belleville washer. The compression ring 70 is compressed between the backhead 72 and the mounting hub 34 to bias the backhead 72 and mounting hub 34 into engagement with the backhead snap ring (not shown) and the main bore snap ring 68, respectively. The snap rings 68 and compression ring 70 are subject to vibration induced-wear which can lead to failure. Other conventional impact drills have utilized a unitary backhead/mounting hub structure to eliminate the need for snap rings and compression rings. However, such unitary structures are complicated to design and expensive to manufacture.

Figure 2:
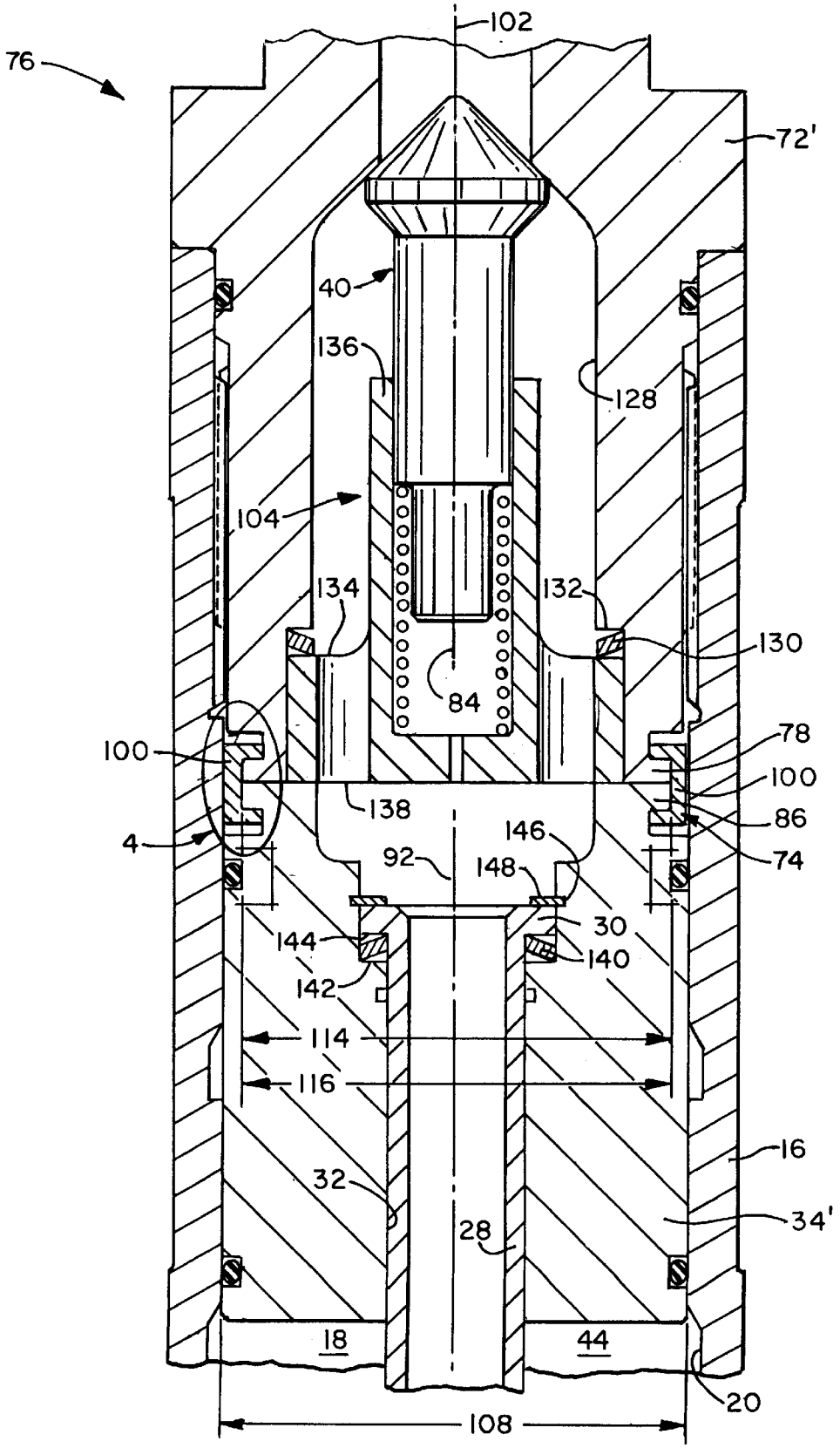
FIG. 2 is an enlarged longitudinal section view, partly broken away, of the casing, backhead, inlet check valve, split ring, mounting hub, and fluid delivery tube of a downhole impact drill in accordance with the present invention.
Figure 3:
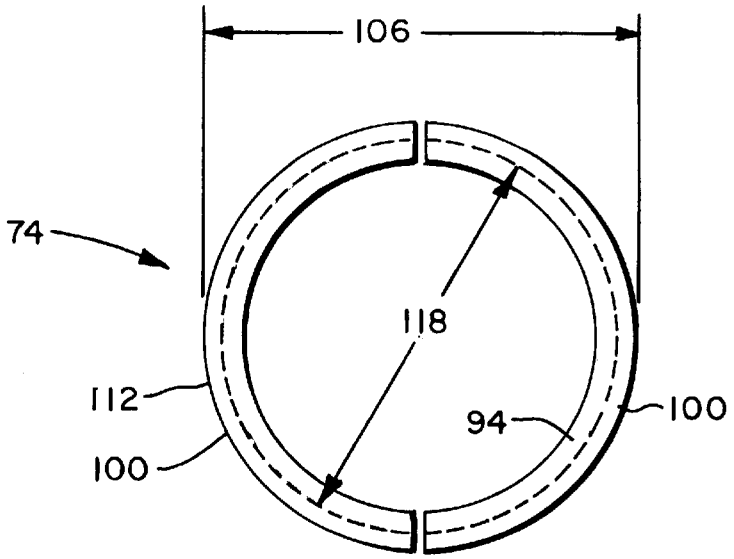
FIG. 3 is an enlarged top view of the split ring of FIG. 2.
Figure 4:
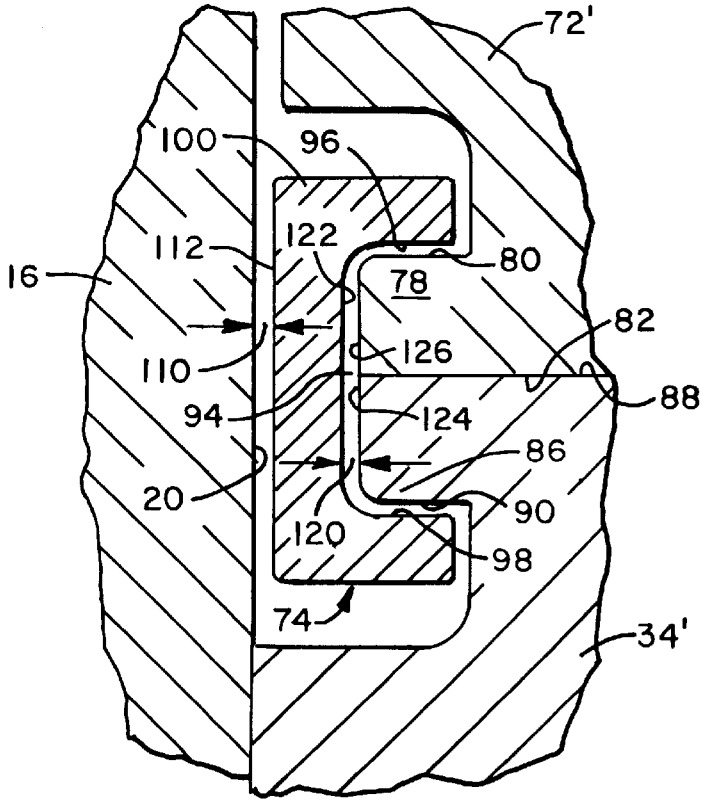
FIG. 4 is an enlarged longitudinal section view of Area 4 of FIG. 2.

With reference to FIGS. 2 and 3, a split ring 74 mounts the backhead 72' to the mounting hub 34' in a downhole impact drill 76 in accordance with the invention. A radially extending flange 78 on the backhead 72' has upper and lower surfaces 80, 82 that are substantially perpendicular to axis 84 of the backhead 72'. Similarly, a radially extending flange 86 on the mounting hub 34' has upper and lower surfaces 88, 90 that are substantially perpendicular to the axis 92 of the mounting hub 34'. The split ring 74 has an interior circumferential groove 94 forming upper and lower shoulders 96,98 and comprises two substantially identical semicircular ring segments 100. The upper and lower shoulders 96,98 are substantially perpendicular to the axis 102 of the drill 76 when the split ring 74 is installed.

The lower surface 82 of the backhead flange 78 is positioned adjacent the upper surface 88 of the mounting hub flange 86 and the backhead and mounting hub flanges 78, 86 are inserted into the groove 94 in each ring segment 100 to form a backhead/mounting hub assembly 104. The upper shoulder 96 of the split ring 74 slidably engages the upper surface 80 of the backhead flange 78 and the lower shoulder 98 slidably engages the lower surface 90 of the mounting hub flange 86 to mount the backhead 72' to the mounting hub 34'. The upper and lower surfaces 80, 88, 82, 90 of both flanges 78, 86 and the upper and lower shoulders 96, 98 of the split ring 74 are machined such that they are substantially flat to ensure that the backhead 72', mounting hub 34', and split ring 74 are not cocked relative to each other and to facilitate lateral movement therebetween. When the backhead/mounting hub assembly 104 is mounted in the casing 16, the casing wall retains the split ring 74 in position around the backhead and mounting hub flanges 78, 86.

The outside diameter 106 of the split ring 74 (FIG. 3) is sufficiently smaller than the inside diameter 108 of the casing 16 to provide a gap 110 between the outside surface 112 of the split ring 74 and the inside surface 20 of the casing 16. Similarly, the outside diameter 114 of the mounting hub flange 86 and the outside diameter 116 of the backhead flange 78 (FIG. 2) are sufficiently smaller than the inside diameter 118 of the groove 94 in the split ring 74 (FIG. 3) to provide a gap 120 between the inside surface 122 of the groove 94 and the outside surfaces 124, 126 of the mounting hub and backhead flanges 86, 78. Taken together, the two gaps 110, 120 allow 10 to 20 thousandths of an inch of lateral relative movement between the split ring 74 and the mounting hub and backhead flanges 86, 78. Consequently, the mounting hub 34' may move laterally relative to the backhead 72' to properly align the bore 32 in the mounting hub 34' and the fluid delivery tube 28 mounted in bore 32 with the bore 36 in the piston 14. The floating connection between the backhead 72' and the mounting hub 34' allows the two components to be joined without impacting the tolerances to which the components must be manufactured to ensure that the fluid delivery tube 28 is properly aligned with the piston bore 36.

A first belleville-style compression ring 130 engages a shoulder 132 in the bore 128 of the backhead 72' and a shoulder 134 on the valve body 136 of the inlet check valve 40. When the backhead/mounting hub assembly 104 is assembled, the lower surface 138 of the valve body 136 engages a portion of the upper surface 88 of the mounting hub flange 86 and the compression ring 130 is partially compressed to bias the upper surface 80 of the backhead flange 78 and the lower surface 90 of the mounting hub flange 86 into engagement with the lower and upper shoulders 98, 96 of the split ring 74, respectively. The biasing force of the compression ring 130 is selected to prevent unrestricted relative movement between split ring 74 and the backhead and mounting hub flanges 78, 86 while allowing the lateral relative movement that is required to properly align the bores 128, 32 of the backhead 72' and the mounting hub 34'. Consequently, the wear that would result from unrestricted movement is eliminated.

A second belleville-style compression ring 140 engages a shoulder 142 in bore 32 and the lower surface 144 of the mounting flange 30 of the fluid delivery tube 28. A circumferential groove 146 in the bore 32 of the mounting hub 34' receives a retainer ring 148 to retain the fluid delivery tube 28 in the bore 32. The compression ring 140 must be partially compressed by the mounting flange 30 of the fluid delivery tube 28 to permit installation of the ring 148. Use of the retainer ring 148 and the compression ring 140 simplifies manufacturing of the mounting hub 34' and fluid delivery tube 28, reducing costs, by allowing the use of less restrictive tolerances for the upper portion of the bore 32 and for the mounting flange 30.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A downhole impact drill comprising an elongated cylinder having an inside surface; an operating chamber within the cylinder; a backhead having a radially extending flange and defining a bore for supplying a flow of pressure fluid to the operating chamber, the flange having an outside surface; a mounting hub defining an axially extending bore and having a radially extending flange disposed adjacent the flange of the backhead, the flange having an outside surface; an elongated pressure fluid delivery tube for directing the flow of pressure fluid within the operating chamber, the fluid delivery tube having an end portion mounted within the bore of the mounting hub; and a ring defining a circumferential inner groove for receiving the flange of the backhead and the flange of the mounting hub, the ring having an outside surface, the groove of the ring having an inside surface; wherein the outside surface of the ring and the inside surface of the cylinder define a first gap and the inside surface of the groove of the ring and the outside surface of the flange of the backhead and the outside surface of the flange of the mounting hub define a second gap, whereby the first and second gaps allow lateral relative movement between the mounting hub and the backhead.

2. The downhole impact drill of claim 1 wherein the flange of the backhead has upper and lower surfaces, the flange of the mounting hub has upper and lower surfaces, and the groove of the ring defines upper and lower shoulders and the drill further comprises biasing means for biasing the upper surface of the flange of the backhead and the lower surface of the flange of the mounting hub to slidably engage the upper and lower shoulders of the ring, respectively, to mount the backhead to the mounting hub.

3. The downhole impact drill of claim 2 wherein the backhead defines a bore having a shoulder, the drill further comprises a check valve assembly mounted in the bore of the backhead, the check valve assembly having an upper shoulder and a lower surface engaged with the upper surface of the flange of the mounting hub, and the biasing means comprises a compression ring disposed intermediate the shoulder of the bore of the backhead and the shoulder of the valve body, whereby the compression ring is at least partially compressed to bias the upper surface of the flange of the backhead and the lower surface of the flange of the mounting hub into engagement with the lower and upper shoulders of the ring, respectively.

4. A downhole impact drill comprising an elongated vertical cylinder; an operating chamber within the cylinder; a backhead having a radially extending flange and defining a bore for supplying a flow of pressure fluid to the operating chamber; an elongated pressure fluid delivery tube for directing the flow of pressure fluid within the operating chamber; a mounting hub having a radially extending flange and defining an axially extending bore for mounting the fluid delivery tube within the cylinder; a retainer ring; a first compression ring; and a ring defining a circumferential inner groove for receiving the flange of the backhead and the flange of the mounting hub, thereby mounting the mounting hub to the backhead, the bore of the mounting hub defining a shoulder and a circumferential groove, the fluid delivery tube includes a mounting flange having upper and lower surfaces, the mounting flange being disposed in the bore of the mounting hub, the retainer ring being disposed in the groove of the mounting hub, and the first compression ring being disposed intermediate the lower surface of the mounting flange and the shoulder of the bore of the mounting hub, whereby the first compression ring is at least partially compressed to bias the upper surface of the mounting flange into contact with the retaining ring.

5. A downhole impact drill comprising:

an elongated vertical cylinder having an inside surface;

an operating chamber within the cylinder;

a backhead having a radially extending flange having an outside surface and defining a bore for supplying a flow of pressure fluid to the operating chamber;

an elongated pressure fluid delivery tube for directing the flow of pressure fluid within the operating chamber;

a mounting hub having a radially extending flange including an outside surface, and defining an axially extending bore for mounting the fluid delivery tube within the cylinder; and a ring defining a circumferential inner groove for receiving the flange of the backhead and the flange of the mounting hub, thereby mounting the mounting hub to the backhead, the ring having an outside surface, the groove of the ring having an inside surface;

wherein the outside surface of the ring and the inside surface of the cylinder define a first gap and the inside surface of the groove of the ring and the outside surface of the flange of the backhead and the outside surface of the flange of the mounting hub define a second gap, whereby the first and second gaps allow lateral relative movement between the mounting hub and the backhead.

6. The downhole impact drill of claim 5 wherein the first and second gaps allow 10 to 20 thousands of an inch of lateral relative movement between the mounting hub and the backhead.

7. The downhole impact drill of claim 5 wherein the ring comprises first and second semi-circular shaped ring segments.

8. A downhole impact drill comprising:

an elongated vertical cylinder;

an operating chamber within the cylinder;

a backhead having a radially extending flange having upper and lower surfaces and defining a bore for supplying a flow of pressure fluid to the operating chamber, the bore having a shoulder;

an elongated pressure fluid delivery tube for directing the flow of pressure fluid within the operating chamber;

a mounting hub having a radially extending flange having upper and lower surfaces and defining an axially extending bore for mounting the fluid delivery tube within the cylinder;

a ring defining a circumferential inner groove for receiving the flange of the backhead and the flange of the mounting hub, thereby mounting the mounting hub to the backhead, the groove of the ring defining upper and lower shoulders, the upper shoulder of the ring slidably engaging the upper surface of the backhead flange and the lower shoulder slidably engaging the lower surface of the mounting hub flange to mount the backhead to the mounting hub;

a check valve assembly disposed in the cylinder having a valve body including an upper shoulder and a lower surface engaged with the upper surface of the flange of the mounting hub; and a first compression ring disposed intermediate the shoulder of the bore of the backhead and the shoulder of the valve body, whereby the first compression ring is at least partially compressed to bias the upper surface of the flange of the backhead and the lower surface of the flange of the mounting hub into engagement with the lower and upper shoulders of the ring, respectively.

9. The downhole impact drill of claim 8 wherein the drill has an axis, the upper and lower surfaces of the flange of the backhead, the upper and lower surfaces of the flange of the mounting hub, and the upper and lower shoulders of the ring are substantially perpendicular to axis of the drill.

10. A downhole impact drill comprising:

an elongated vertical cylinder;

an operating chamber within the cylinder;

a backhead having a radially extending flange and defining a bore for supplying a flow of pressure fluid to the operating chamber;

an elongated pressure fluid delivery tube for directing the flow of pressure fluid within the operating chamber, the fluid delivery tube including a mounting flange having upper and lower surfaces;

a mounting hub having a radially extending flange and defining an axially extending bore for mounting the fluid delivery tube within the cylinder, the bore of the mounting hub defining a shoulder and a circumferential groove;

a ring defining a circumferential inner groove for receiving the flange of the backhead and the flange of the mounting hub, thereby mounting the mounting hub to the backhead;

a retainer ring; and a second compression ring;

wherein the mounting flange is disposed in the bore of the mounting hub, the retainer ring is disposed in the groove, and the second compression ring is disposed intermediate the lower surface of the mounting flange and the shoulder of the bore, whereby the second compression ring is at least partially compressed to bias the upper surface of the mounting flange into contact with the retaining ring.

* * * * *